US011076706B2

(12) United States Patent
McLusky

(10) Patent No.: US 11,076,706 B2
(45) Date of Patent: Aug. 3, 2021

(54) CONFIGURABLE MULTIPURPOSE MAT ASSEMBLY

(71) Applicant: Jared W McLusky, Commerce City, CO (US)

(72) Inventor: Jared W McLusky, Commerce City, CO (US)

( * ) Notice: Subject to any disclaimer, the term of this patent is extended or adjusted under 35 U.S.C. 154(b) by 210 days.

(21) Appl. No.: 16/250,521

(22) Filed: Jan. 17, 2019

(65) Prior Publication Data

US 2019/0216233 A1 Jul. 18, 2019

Related U.S. Application Data

(60) Provisional application No. 62/618,152, filed on Jan. 17, 2018.

(51) Int. Cl.

| | |
|---|---|
| ***A47D 13/08*** | (2006.01) |
| ***A47D 15/00*** | (2006.01) |
| ***A47D 5/00*** | (2006.01) |

(52) U.S. Cl.

CPC ..... *A47D 13/08* (2013.01); *A47D 5/00* (2013.01); *A47D 15/003* (2013.01); *A47D 15/005* (2013.01); *A47D 15/008* (2013.01)

(58) Field of Classification Search

CPC ..... A47C 27/18; A47D 5/00; A47D 15/003; A47D 13/08; A47D 15/008; A47D 13/083; A47G 9/00

See application file for complete search history.

(56) References Cited

U.S. PATENT DOCUMENTS

| | | | | |
|---|---|---|---|---|
| 2,629,884 A | | 3/1953 | McMonagle | |
| 2,644,173 A | | 7/1953 | James | |
| 4,709,430 A | * | 12/1987 | Nicoll | A47G 9/062 383/4 |
| 4,754,509 A | | 7/1988 | Pollard | |
| 4,802,244 A | | 2/1989 | Melissa Mcgrath-Saleh | |
| 5,103,514 A | | 4/1992 | Leach | |
| 5,165,130 A | * | 11/1992 | Wendling | A47D 13/08 5/424 |
| 5,272,780 A | | 12/1993 | Clute | |
| 5,367,730 A | | 11/1994 | Sher | |
| 5,530,974 A | | 7/1996 | Rains | |
| 5,581,832 A | | 12/1996 | Bridley | |
| 5,813,066 A | | 9/1998 | Gebhard | |

(Continued)

FOREIGN PATENT DOCUMENTS

| | | | | |
|---|---|---|---|---|
| EP | 1051934 A1 | * | 11/2000 | A47D 15/003 |
| WO | WO-2010033556 A2 | * | 3/2010 | A47D 15/008 |

*Primary Examiner* — David R Hare
*Assistant Examiner* — Madison Emanski
(74) *Attorney, Agent, or Firm* — Leyendecker & Lemire, LLC

(57) ABSTRACT

A configurable multipurpose mat assembly is described. The configurable multipurpose mat assembly typically comprises a center area for receiving a baby, and two barriers on opposite sides of the center area for confining a baby there between. Variations of the configurable multipurpose mat assembly may include compressible or inflatable components that permit the mat assembly to be compressed or rolled without disassembly. In other variations, the configurable multipurpose mat assembly may include liquid impervious sheaths to provide a protective barrier between the components of the mat assembly and undesirable liquids.

20 Claims, 6 Drawing Sheets

(56) References Cited

U.S. PATENT DOCUMENTS

| | | | | |
|---|---|---|---|---|
| 6,560,800 | B1 * | 5/2003 | Draves | A47C 20/023 5/630 |
| 7,086,101 | B2 * | 8/2006 | Welch | A47D 7/04 5/425 |
| 7,178,186 | B2 | 2/2007 | Stuart Hanis | |
| 2005/0011008 | A1 | 1/2005 | Welch | |
| 2005/0210592 | A1 | 9/2005 | Littlehorn | |
| 2009/0007336 | A1 | 1/2009 | Kassai | |
| 2009/0235461 | A1 | 9/2009 | Straub | |
| 2010/0088824 | A1 | 4/2010 | Tanner | |
| 2011/0107518 | A1 | 5/2011 | Kelly | |
| 2016/0135612 | A1 * | 5/2016 | Morton | A47D 13/08 5/424 |

* cited by examiner

CONFIGURABLE MULTIPURPOSE MAT ASSEMBLY

CROSS-REFERENCE TO RELATED APPLICATION

The present application claims the benefit of and priority to U.S. Provisional Patent Application No. 62/618,152, filed Jan. 17, 2018, the entire contents of which are hereby incorporated by reference.

BACKGROUND

Parents often desire to lay babies down on nearby surfaces, such as a couch or bed, to enable the parent to complete other tasks while keeping baby nearby. Often times the most convenient or accessible surface to lay the baby down does not have the necessary barrier to prevent the baby from rolling off the surface and onto the floor, which could result in serious injury to the baby. Traditional barrier mats are designed to ensure that the baby is restricted to one position, typically on their side. While this may be an ideal position if the baby is sleeping, when the baby is awake, freedom to roll from side to side and look around the room is preferred, while still having a means for preventing baby from rolling onto the floor or other undesired surface.

DETAILED DESCRIPTION

Figure 1:
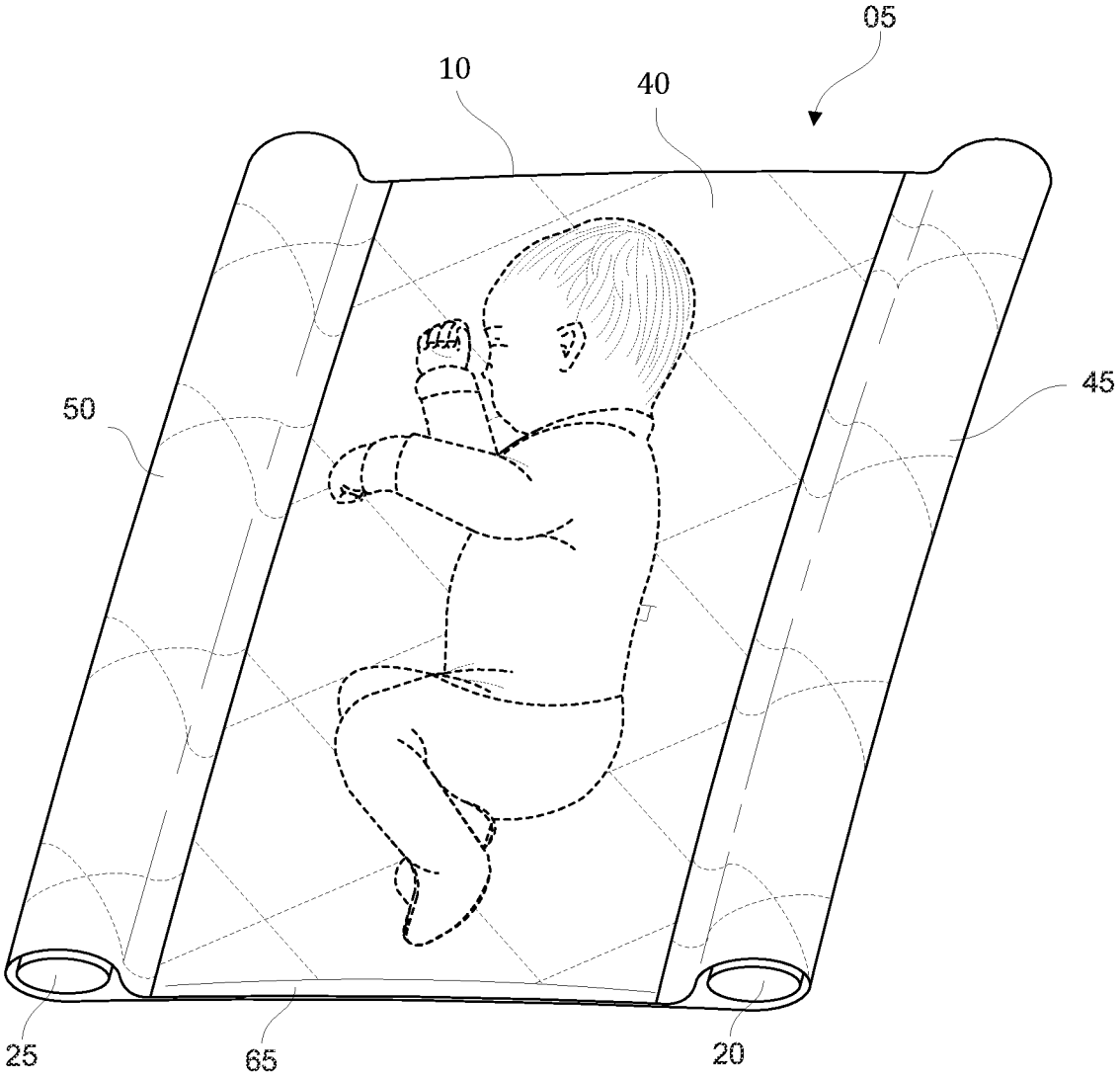
FIG. 1 is a perspective view of a configurable multipurpose mat assembly according to one embodiment of the present invention.

Embodiments of the present invention include a configurable multipurpose mat assembly. Various embodiments of the configurable multipurpose mat assembly are illustrated in FIGS. 1-6 and described herein. As can be appreciated—and is also discussed herein—other variations are also possible as would be obvious to someone of ordinary skill given the benefit of this disclosure.

Embodiments of the configurable multipurpose mat assembly are each typically configured to have a center pocket portion for receiving a baby, and two barrier sleeve portions on opposite sides of the center pocket portion for confining a baby there between. The center pocket portion and the two barrier sleeve portions are typically configured to allow for removable pads to be easily removed or replaced as needed. The simple disassembly and subsequent reassembly of the configurable multipurpose mat assembly allows for the user to easily configure the mat assembly to his or desired configuration, and to launder the fabric cover or wipe down the removable pads in variations where the removable pads are encased in a sheath comprising a liquid impervious or water-resistant material.

In some variations, the removable pads may comprise a self-inflating foam pad or other inflatable material to allow for the configurable multipurpose mat assembly to be rolled or folded for easy storage or travel, and allow for the removable pads to inflate when being released from a stored configuration and to deflate when being returned to a compressed stored configuration. Other variations provide for the removable pads to be encased within liquid impervious or water-resistant sheaths, to protect the removable pads from contact with undesirable liquids, such as bodily fluids or formula, which would otherwise be difficult to clean off of the removable pads in a satisfactory manner. These sheaths allow for the user to easily wipe away any liquid that penetrates the fabric cover and onto the sheathed removable pads with a cloth, sanitizing wipe, or similar material.

Typically, the baby will be placed between the left and right barrier sleeve portions, oriented longitudinally, so that each of the left and right barrier sleeve portions prevent the baby from rolling off of the configurable multipurpose mat assembly. This orientation can be used for a variety of purposes, such as changing the baby's diaper or placing the baby down for resting when away from home or a crib. The baby may also be placed laterally, resting his or head on either of the left and right barrier sleeve portion. This orientation can be used when the baby is awake and alert and would benefit from seeing the activity in the room around the baby.

As can be appreciated, the configurable multipurpose mat assembly can be used for any suitable purpose and may be configured for a variety of uses. For instance, the mat assembly can be placed underneath a child during meal time, to protect the surrounding area from food debris. The mat assembly can be used for any purpose wherein it is desirable to either provide a child with a clean surface on which to sit or lay, or provide a cover to protect the underlying surface from soiling as a result of the child. Further, the mat assembly can be used in a variety of different configurations. For instance, configurations are contemplated wherein the removable center pad insert is removed, permitting the positioning of the left and right barrier sleeve portions to be easily adjusted inwardly or outwardly. Additionally, the configurable multipurpose mat assembly can be used with center pad inserts of differing shapes and sizes depending on the desired barrier sleeve portion positioning. In yet other embodiments, the configurable multipurpose mat assembly can be used without the barrier pad inserts or the center pad insert, such as when a clean barrier is all that is desired.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "about," as used in this specification and appended claims, refers to plus or minus 20% of the value given.

The term "approximately," as used in this specification and appended claims, refers to plus or minus 10% of the value given.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The terms "generally" and "substantially," as used in this specification and appended claims, mean mostly, or for the most part.

The term "or" as used in this specification and the appended claims is not meant to be exclusive; rather the term is inclusive, meaning either or both.

The term "pad" is used in a functional sense indicating a generally supportive form. The preferred embodiment employs a pad formed from open celled or close celled foam. This material is readily available, and those of skill in the art are familiar with working with such foam. Other materials are available that would be suitable for other embodiments of the subject matter of the disclosure. Examples are a pillow or cushion filled with down or fibre material, an inflatable or self-inflating cushion, or any other similar materials. Those in the art will understand that in any suitable material, now known or hereafter developed, may be used in forming the pad described herein.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

Directional and/or relationary terms such as, but not limited to, left, right, nadir, apex, top, bottom, vertical, horizontal, back, front, longitudinal, and lateral are relative to each other and are dependent on the specific orientation of a applicable element or article, and are used accordingly to aid in the description of the various embodiments and are not necessarily intended to be construed as limiting.

A First Embodiment Configurable Multipurpose Mat Assembly

Referring to FIGS. 1-6, detailed diagrams of an embodiment of a configurable multipurpose mat assembly 5 are illustrated. Typically, the configurable multipurpose mat assembly 5 can include a fabric cover 10, a center pad 15, an elongated left barrier pad 25, and an elongated right barrier pad 20.

The fabric cover 10 is typically formed by joining together a first fabric sheet 30 and a second fabric sheet 35. The first fabric sheet 30 is typically a soft fabric material, including natural and synthetic fibers. In one variation, the first fabric sheet 30 may comprise a fleece or velour material. In another variation, the first fabric sheet 30 may comprise a cotton or cotton-blend woven fabric. In another variation, the first fabric sheet 30 may include quilted stitching to secure a layer of fiberfill batting to the side of the first fabric sheet 30 touching the center pad 15. The second fabric sheet 35 is typically a soft fabric material, including natural and synthetic fibers. In one variation, the second fabric sheet 35 may comprise a slip-resistant or nonskid material, such as a silicone woven fabric. In another variation, the second fabric sheet 35 may comprise a water-resistant material, such as nylon or polyester. In another variation, the fabric cover 10 may comprise a fabric sheet folded lengthwise to form a first side 30 and a second side 35. Typically, the fabric cover 10 is machine washable.

Figure 6:
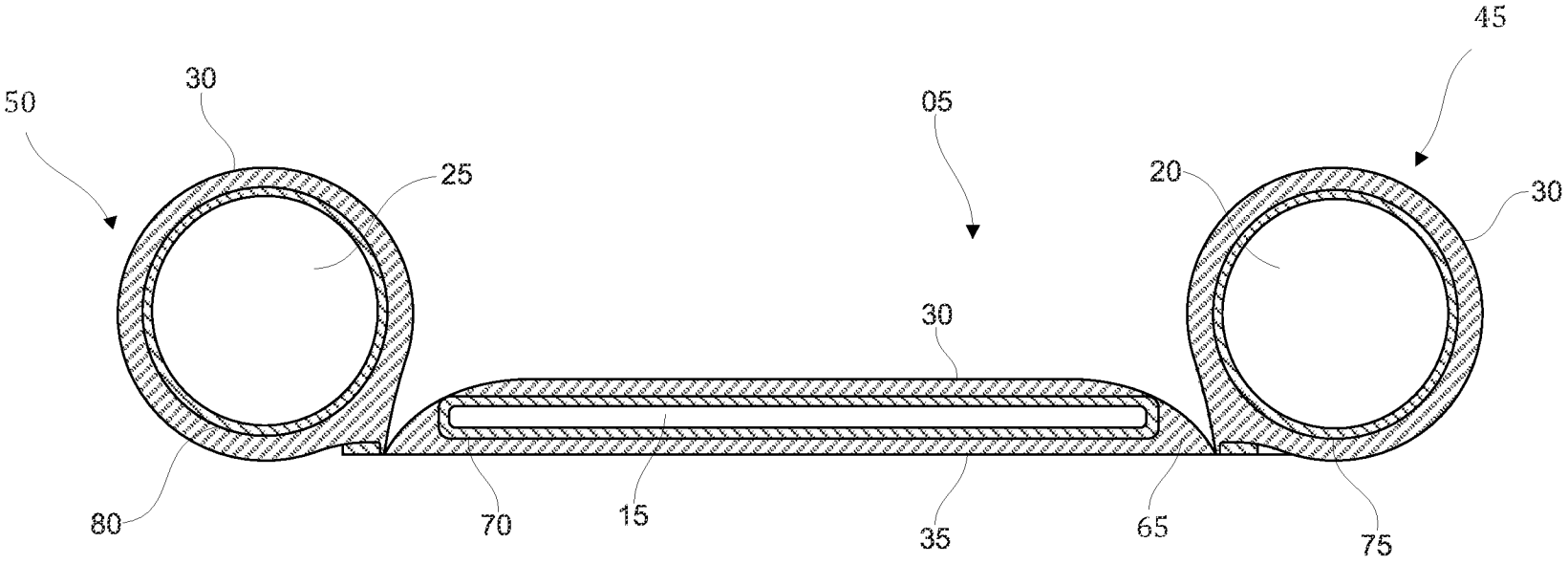
FIG. 6 is a cross sectional end view of a configurable multipurpose mat assembly according to one embodiment of the present invention.

As illustrated in FIG. 1, the fabric cover 10 comprises a center pocket portion 40, a right barrier sleeve portion 45, and a left barrier sleeve portion 50. As shown in FIG. 6, the right barrier sleeve portion 45 and the left barrier sleeve portion 50 typically comprise a first fabric sheet 30. In one variation, the right barrier sleeve portion 45 and the left barrier sleeve portion 50 may comprise a first fabric sheet 30 and a second fabric sheet 35.

Figure 2:
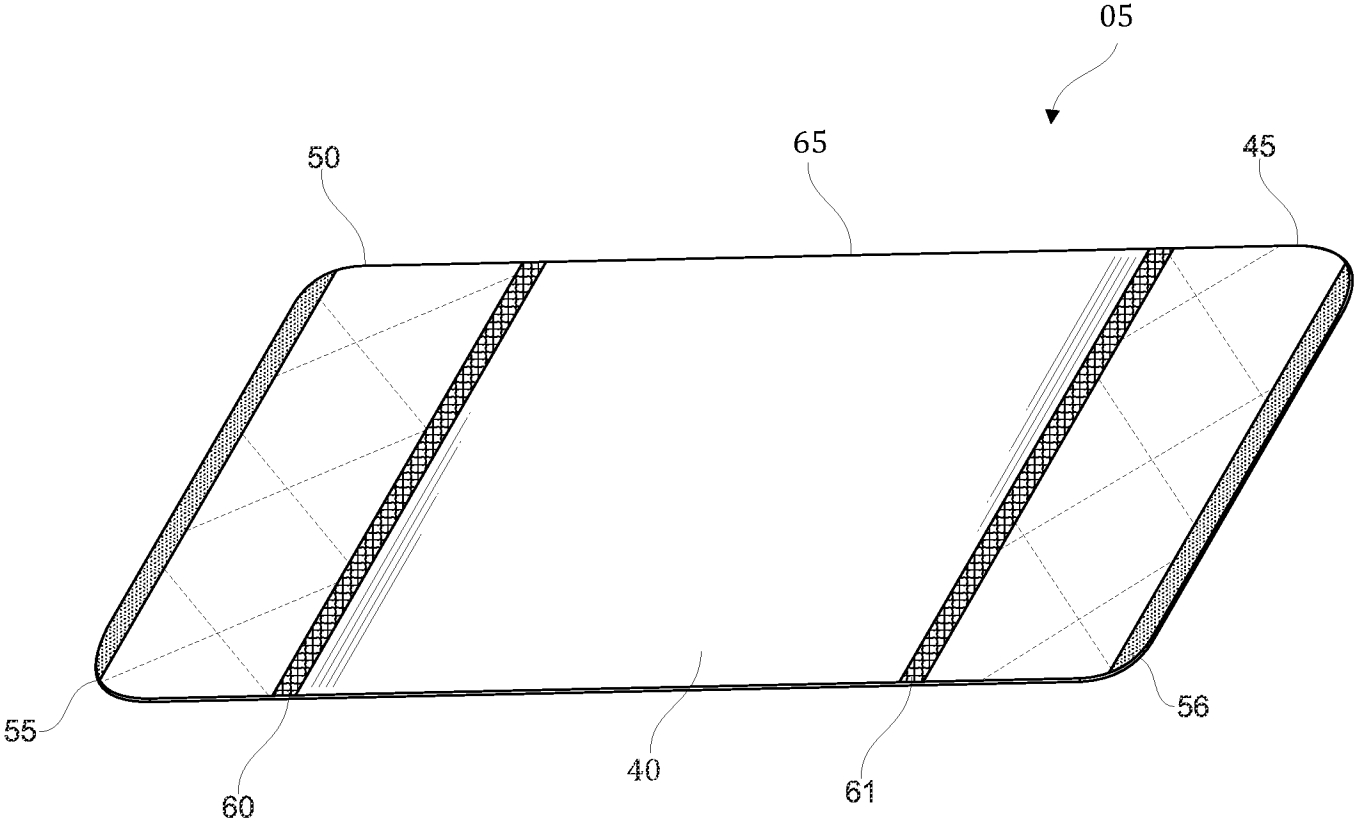
FIG. 2 is a perspective view of the underside of a configurable multipurpose mat assembly fabric cover according to one embodiment of the present invention.
Figure 3:
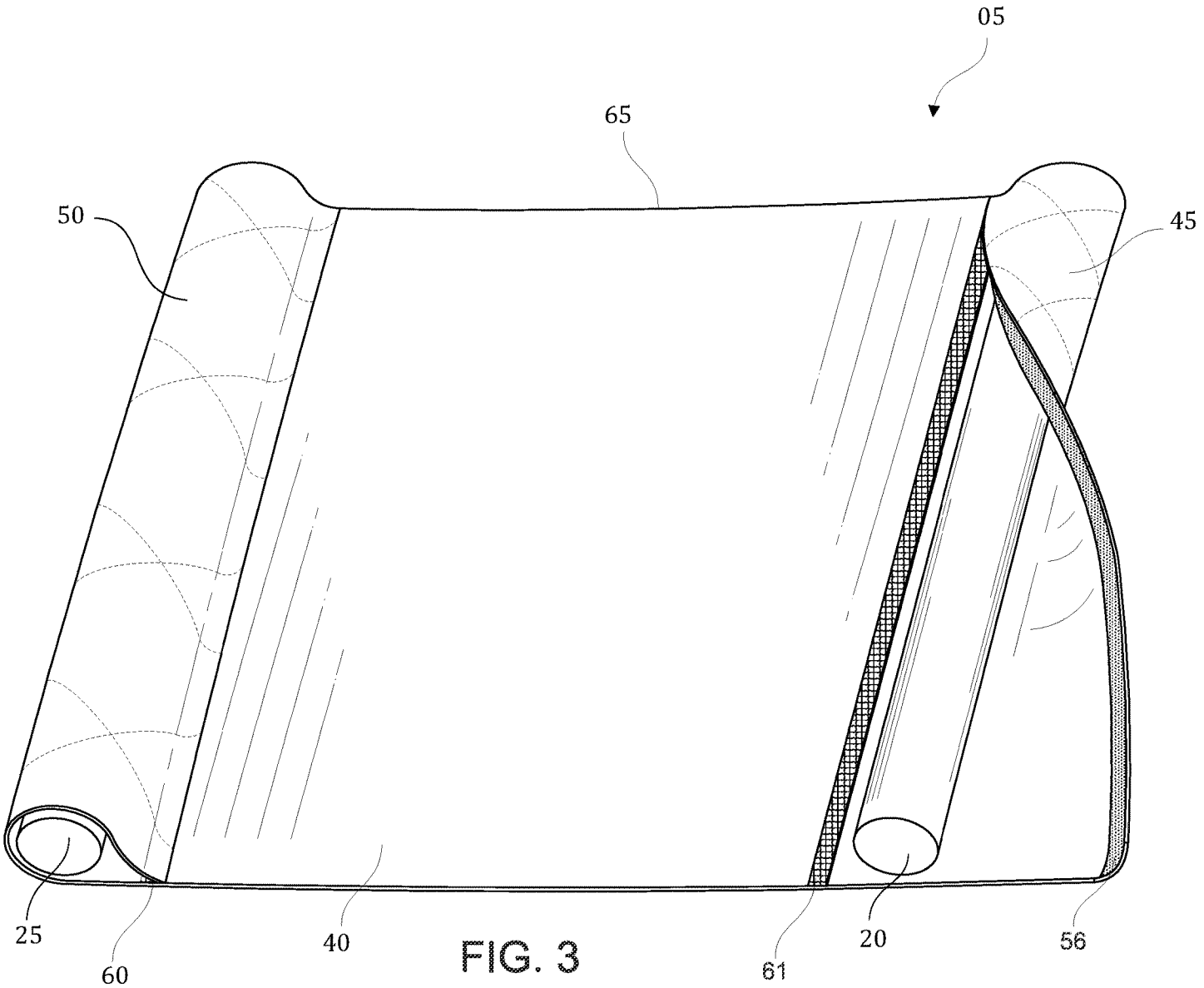
FIG. 3 is a perspective view of the underside of a configurable multipurpose mat assembly according to one embodiment of the present invention.

In the configuration illustrated in FIG. 1, a right barrier sleeve portion 45 is wrapped around an elongated right barrier pad 20, and a left barrier sleeve portion 50 is wrapped around an elongated left barrier pad 25. As shown in FIGS. 2 and 3, the right barrier sleeve portion 45 is secured in place by anchoring a first right barrier fastening piece 61 to a second right barrier fastening piece 56, and the left barrier sleeve portion 50 is secured in place by anchoring a first left barrier fastening piece 60 to a second left barrier fastening piece 55. Typically the right barrier sleeve portion 45 and the left barrier sleeve portion 50 are secured to the center pocket portion 40 to form a tubular cavity in the shape of the elongated right barrier pad 20 and the elongated left barrier pad 25 and permit the elongated right barrier pad 20 and the elongated left barrier pad 25 to be held in place.

In one variation, the left barrier fastening pair (comprising the first left barrier fastening piece 60 and the second left barrier fastening piece 55) and the right barrier fastening pair (comprising the first right barrier fastening piece 61 and the second right fastening piece 56) each comprise a hook and loop fastening system. In another variation, the left barrier fastening pair and the right barrier fastening pair each comprise a clasp locker fastening system, such as a zipper. In another variation, a series of small fasteners, such as buttons or snaps, may be placed along the length of the left and right barrier fastening pieces to enable the right barrier sleeve portion 45 and the left barrier sleeve portion 50 to be secured in place. In another variation, the right barrier sleeve portion 45 and the left barrier sleeve portion 50 may comprise a fabric sheet of upwardly facing loop fasteners to permit the right barrier sleeve portion 45 and the left barrier sleeve portion 50 to be secured to a respective first right barrier fastening piece 61 and a first left barrier fastening piece 60, each of the right and left barrier fastening pieces comprising downwardly facing hook fasteners. In another variation, the right barrier sleeve portion 45 and the left barrier sleeve portion 50 may comprise additional barrier fastener pieces to permit the location of the secured elongated right barrier pad 20 and the elongated left barrier pad 25 to vary, thereby varying the width of the center pocket portion 40. For instance, in some circumstances, such as when changing a diaper, it may be desirable to have the distance between the elongated right barrier pad 20 and the elongated left barrier pad 25 as wide as possible to facilitate access to the baby and the side of the baby by the caregiver in accomplishing a diaper change. In another circumstance, it may be desirable to have the elongated right barrier pad 20 and the elongated left barrier pad 25 be flush against the baby, such as when the baby is napping, to prevent the baby from rolling over.

As illustrated in FIGS. 1 and 3-6, the elongated right barrier pad 20 and the elongated left barrier pad 25 typically comprise a fiberfill material in a cylindrical configuration with a circular cross-section, with the longitudinal length of the elongated right barrier pad 20 being approximately the same length of the right pocket edge of the center pocket portion 40 and the elongated left barrier pad 25 being approximately the same length of the left pocket edge of the center pocket portion 40. Typically, the elongated right barrier pad 20 and the elongated left barrier pad 25 have a respective right and left lateral width at least five times greater than the thickness of the center pad 15.

In one variation, the elongated right barrier pad 20 and the elongated left barrier pad 25 may comprise an open celled or close celled foam. In another variation, the elongated right barrier pad 20 and the elongated left barrier pad 25 may comprise a self-inflating foam pad and sealable air valve. In another variation, the elongated right barrier pad 20 and the elongated left barrier pad 25 may comprise an inflatable material and a sealable air valve allowing for oral inflation. As illustrated in FIG. 6, in some variations, the elongated right barrier pad 20 and the elongated left barrier pad 25 may be substantially encased within a right sheath 75 and a left sheath 80, respectively. The right sheath 75 and the left sheath 80 typically comprises a water-resistant material, such as thin plastic sheeting. In another variation, the right sheath 75 and the left sheath 80 may comprise a water-resistant woven or non-woven fabric.

The center pocket portion 40 typically comprises a coextending first fabric sheet 30 and a second fabric sheet 35. As illustrated in FIG. 2, the center pocket portion 40 is typically defined by a first left barrier fastening piece 60 proximate the left edge of the center pocket portion 40 and a first right fastening piece 61 proximate the right edge of the center pocket portion 40. The center pocket portion 40 typically has a receiving pocket end 65 for receiving a center pad 15 therein. In one variation, the center pocket portion 40 has a receiving pocket end 65 at either of the two ends of the center pocket portion 40 perpendicular to the right barrier sleeve portion 45 or the left barrier sleeve portion 50.

Figure 4:
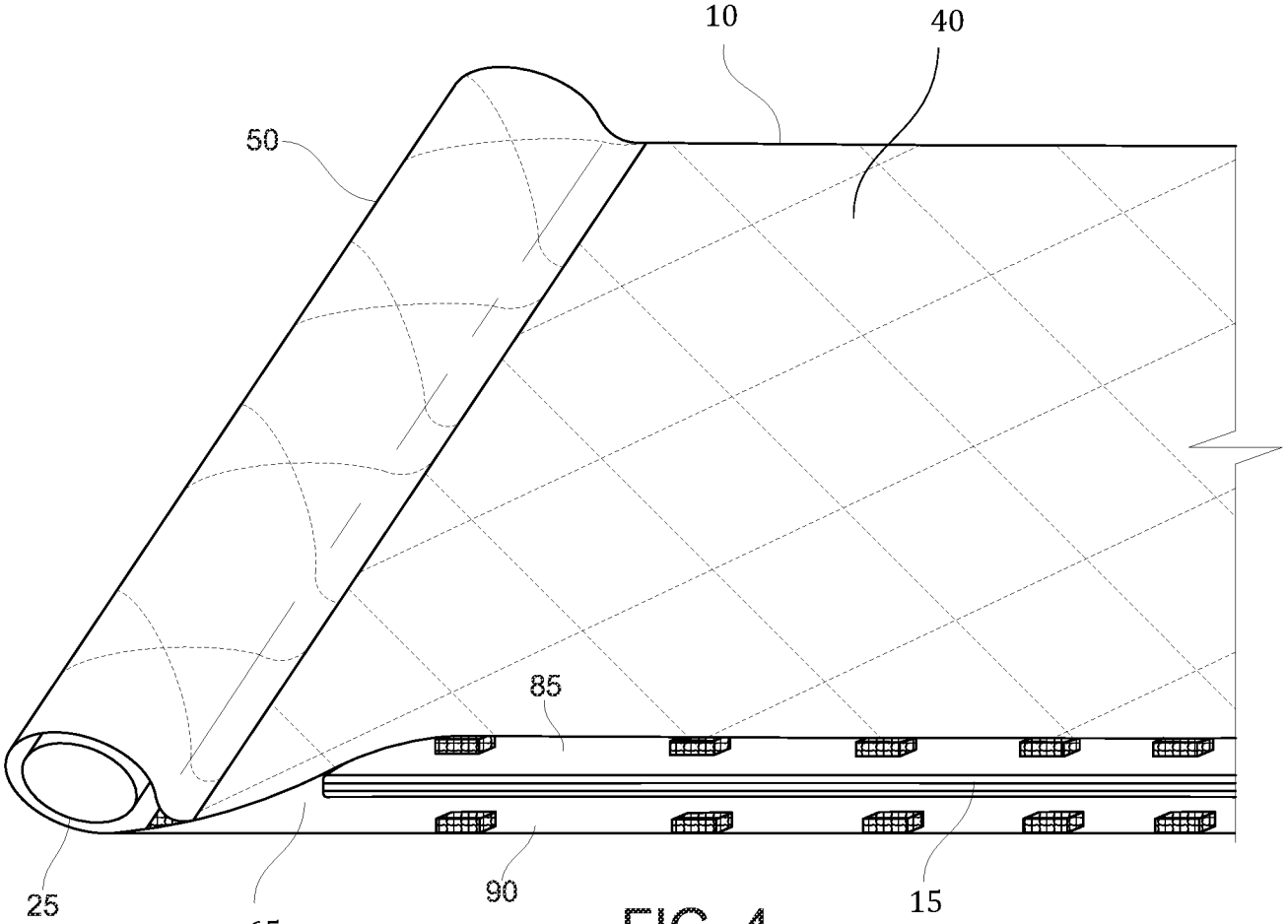
FIG. 4 is a perspective view of a configurable multipurpose mat assembly receiving pocket end and pocket closure assembly according to one embodiment of the present invention.

As illustrated in FIG. 4, the center pocket portion 40 typically has a receiving pocket end 65 including a pocket closure assembly comprising a top pocket closure piece 85 and a bottom pocket closure piece 90. The center pad 15 is slid into the receiving pocket end 65 and entirely enclosed within the center pocket portion 40, as shown in FIG. 1. As illustrated in FIG. 4, the top pocket closure piece 85 may be affixed to the bottom pocket closure piece 90 to enclose and securably hold the removable center pad 15 therein. Typically, the top pocket closure piece 85 and the bottom pocket closure piece 90 comprise a hook and loop fastening system. In one variation, the top pocket closure piece 85 and the bottom pocket closure piece 90 may comprise a clasp locker fastening system, such as a zipper. In another variation, a series of small fasteners, such as buttons or snaps, may be placed along the length of the top and bottom pocket closure piece to enable the receiving pocket end 65 to close.

The center pad 15 typically comprises an open celled or close celled foam. In one variation, the center pad 15 comprises a fibrous batting. In another variation, the center pad 15 comprises a pillow insert. In another variation, the center pad 15 may comprise a self-inflating foam pad and sealable air valve. In another variation, the center pad 15 may comprise an inflatable material and a sealable air valve allowing for oral inflation. As illustrated in FIG. 6, in some variations, a center pad 15 may be substantially encased within a center sheath 70. A center sheath 70 typically comprises a liquid impervious or water-resistant material, such as thin plastic sheeting. In another variation, the center sheath 70 may comprise a water-resistant woven or non-woven fabric.

Figure 5:
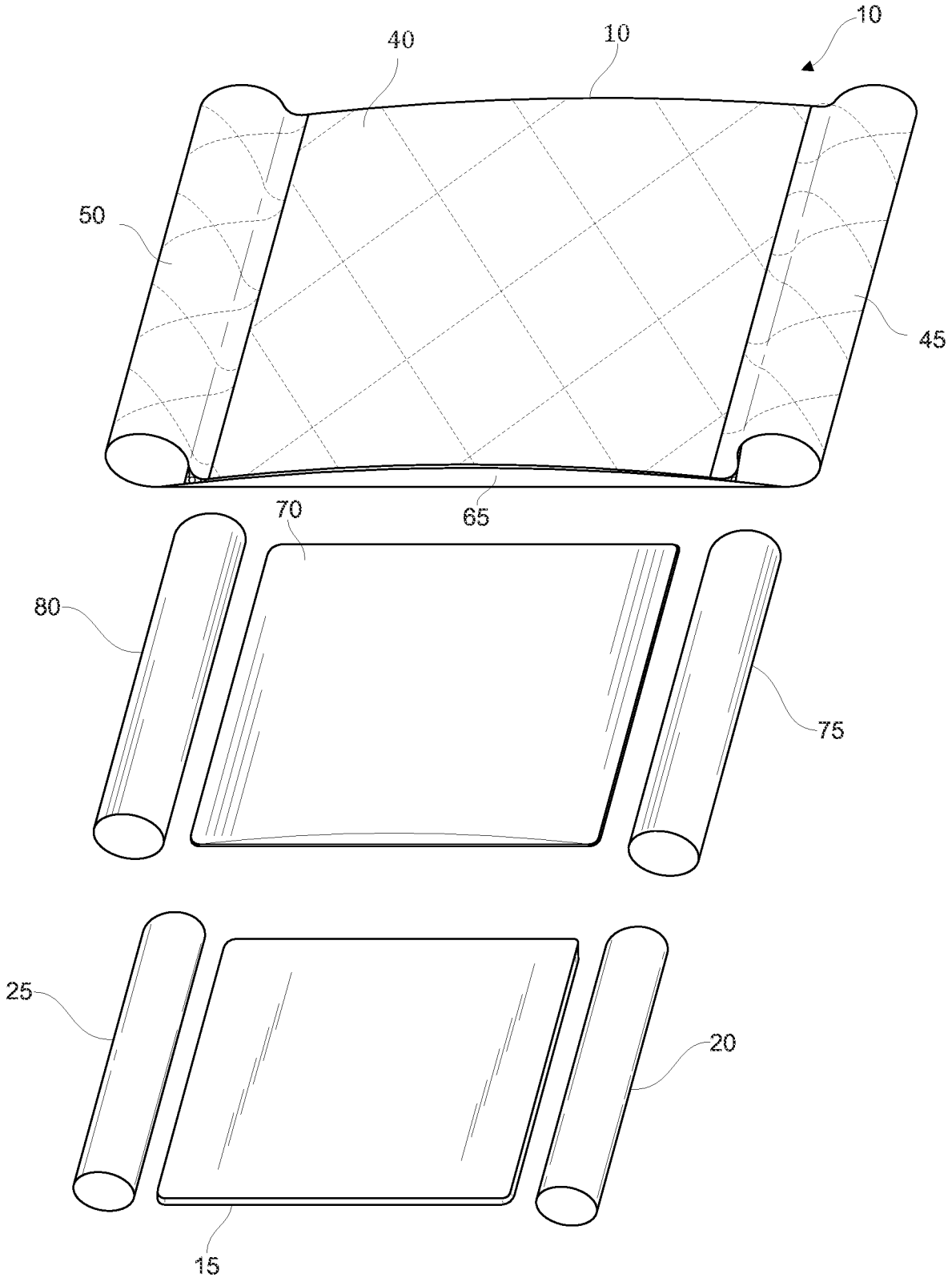
FIG. 5 is an exploded view of a configurable multipurpose mat assembly according to one embodiment of the present invention.

As illustrated in FIGS. 5 and 6, one variation of a configurable multipurpose mat assembly 5 comprises a fabric cover 10, a center pad 15, an elongated right barrier pad 20, an elongated left barrier pad 25, a center pad sheath 70, a right sheath 75, and a left sheath 80.

As illustrated in FIG. 6, a center pad 15 is substantially-encased within a center sheath 70, an elongated right barrier pad 20 is substantially encased within a right sheath 75, and an elongated left barrier pad 25 is substantially encased within a left sheath 80. In one variation, the center pad 15 is substantially encased within a center sheath 70, and the elongated right barrier pad 20 and the elongated left barrier pad 25 are placed directly within a right barrier sleeve portion 45 and a left barrier sleeve portion 50. In another variation, the center pad 15 is placed directly within the center pocket portion 40, and the elongated right barrier pad 20 is substantially encased within the right sheath 75, and the elongated left barrier pad 25 is substantially encompassed within the left sheath 80.

In some variations, the configurable multipurpose mat assembly 5 may be compressed by either folding or rolling the configurable multipurpose mat assembly 5, thereby reducing its volume for transport. To facilitate compression, typically the center pad 15, the elongated right barrier pad 20, and the elongated left barrier pad 25 may comprise a compressible open cell foam. In variations of the configurable multipurpose mat assembly 5 that are configured to be compressed or folded for storage and transport, open cell foam is preferred. In one variation, one or more straps may be provided either separate from or integrated into the fabric cover 10 to secure the configurable multipurpose mat assembly 5 in its compressed form.

In variations of the configurable multipurpose mat assembly 5 that are configured to be compressed or folded for storage or transport, the center sheath 70, the right sheath 75, and the left sheath 80 may include perforations or other openings removed from locations likely to come into contact with undesirable liquids to permit air to flow in and out of the center sheath 70, the right sheath 75, and the left sheath 80 as the configurable multipurpose mat assembly 5 is compressed by either rolling or folding.

In variations of the configurable multipurpose mat assembly 5 that are not configured to be compressed or folded for storage or transport, one or all of the center pad 15, the elongated right barrier pad 20, and elongated left barrier pad 25 may comprise a self-skinning flexible foam to provide a liquid impervious barrier without the use of the center sheath 70, the right sheath 75, or the left sheath 80.

Alternative Embodiments and Variations

The various embodiments and variations thereof, as illustrated in the accompanying Figures or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A configurable multipurpose mat assembly comprising: a center pad having a center thickness; an elongated left barrier pad having a barrier left longitudinal length and a left lateral width; an elongated right barrier pad having a barrier right longitudinal length and a right lateral width, each of the left lateral width and the right lateral width being substantially greater than the center thickness; and a fabric cover having a center pocket portion bordered on a left pocket edge by a left barrier sleeve portion, and bordered on a right pocket edge by a right barrier sleeve portion, the center pocket portion having a receiving pocket end including a pocket closure assembly, the center pocket portion having the center pad removably enclosed therein at the receiving pocket end, the center pocket portion of the fabric cover is integrally formed with both the left barrier sleeve portion and the right barrier sleeve portion, the left barrier sleeve portion including a left fastening assembly and the right barrier sleeve portion including a right fastening assembly, each of the left barrier sleeve portion and the right barrier sleeve portion having at least a first configuration and a second configuration, the left barrier sleeve portion and the right barrier sleeve portions in the first configuration being formed into a tubular sleeve wrapped around the respective elongated left barrier pad or elongated right barrier pad and secured into place with the respective left fastening assembly or the right fastening assembly and the left barrier sleeve portion and the right barrier sleeve portion in the second configuration being laid flat and generally coplanar with the center pocket portion with the respective left fastening assembly and or right fastening assembly being uncoupled.

2. The configurable multipurpose mat assembly of claim 1, wherein the center pad, the elongated left barrier pad, and the elongated right barrier pad are comprised of an open cell foam.

3. The configurable multipurpose mat assembly of claim 1, wherein the center pad, the elongated left barrier pad, and the elongated right barrier pad are inflatable.

4. The configurable multipurpose mat assembly of claim 1, wherein the center pad, the elongated left barrier pad, and the elongated right barrier pad are comprised of a closed cell foam.

5. The configurable multipurpose mat assembly of claim 1, wherein one or more of the center pad, the elongated left barrier pad, and the elongated right barrier pad are encased within water-resistant sheath.

6. The configurable multipurpose mat assembly of claim 2, wherein one or more of the center pad, the elongated left barrier pad, and the elongated right barrier pad are encased within water-resistant sheath, the water-resistant sheath including one or more openings to facilitate the ingress and egress of air from in and out of the water-resistant sheath.

7. The configurable multipurpose mat assembly of claim 5, wherein the water-resistant sheath comprises at least one of a thin plastic sheeting, a coated water-resistant woven fabric, or a coated water-resistant non-woven fabric.

8. The configurable multipurpose mat assembly of claim 1, wherein each of the left lateral width and the right lateral width are at least five times greater than the center thickness.

9. The configurable multipurpose mat assembly of claim 1, wherein the pocket closure assembly comprises one or more pieces of hook material and one or more pieces of loop material.

10. The configurable multipurpose mat assembly of claim 1, wherein the pocket closure assembly comprises one or more of (i) buttons and button holes, (ii) a zipper, and (iii) snaps.

11. The configurable multipurpose mat assembly of claim 1 wherein:

the left barrier fastening assembly comprises at least a first left barrier fastening pair comprising a first left barrier fastening piece and a second left barrier fastening piece configured to removably couple with the first left barrier fastening piece, the first left barrier fastening piece being located proximate the left pocket edge and the second left barrier fastening piece being located proximate a left edge of the left barrier sleeve portion; and the right fastening assembly comprises at least a first right barrier fastening pair comprising a first right barrier fastening piece and a second right barrier fastening piece configured to removably couple with the first right barrier fastening piece, the first right barrier fastening piece being located proximate the right pocket edge and the second right barrier fastening piece being located proximate a right edge of the right barrier sleeve portion.

12. The configurable multipurpose mat assembly of claim 11, wherein each of the first left barrier fastening piece and the first right first barrier fastening piece comprise one of a hook strip and a loop strip, and each of the second left barrier fastening piece and the second right barrier fastening piece comprise the other of the hook strip and the loop strip.

13. The configurable multipurpose mat assembly of claim 12 further comprising a left additional barrier fastening piece and a right additional barrier fastening piece, the left additional barrier fastening piece being located between the first left barrier fastening piece and the second left barrier fastening piece and the left additional barrier fastening piece being configured to couple with the first left barrier fastening piece, the right additional barrier fastening piece being located between the first right barrier fastening piece and the second right barrier fastening piece and the right additional barrier fastening piece being configured to couple with the first right barrier fastening piece.

14. A configurable multipurpose mat assembly comprising: an open cell foam center pad having a center thickness, the center pad being encased within a water-resistant center sheath, the water-resistant center sheath including one or more openings to facilitate the ingress and egress of air from in and out of the water-resistant center sheath; an open cell foam elongated left barrier pad having a barrier left longitudinal length and a left lateral width, the left barrier pad being encased within a water-resistant left sheath, the water-resistant left sheath including one or more openings to facilitate the ingress and egress of air from in and out of the water-resistant left sheath; an open cell foam elongated right barrier pad having a barrier right longitudinal length and a right lateral width, each of the left lateral width and the right lateral width being substantially greater than the center thickness, the right barrier pad being encased within a water-resistant right sheath, the water-resistant right sheath including one or more openings to facilitate the ingress and egress of air from in and out of the water-resistant right sheath; and a fabric cover having a center pocket portion bordered on a left pocket edge by a left barrier sleeve portion, and bordered on a right pocket edge by a right barrier sleeve portion, the center pocket portion having a receiving pocket end including a pocket closure assembly, the center pocket portion having the center pad removably enclosed therein at the receiving pocket end, the center pocket portion of the fabric cover is integrally formed with both the left barrier sleeve portion and the right barrier sleeve portion, the left barrier sleeve portion forming a left tubular sleeve with the elongated left barrier pad received therein, and the right barrier sleeve portions forming a right tubular sleeve with the elongated right barrier pad received therein.

15. The configurable multipurpose mat assembly of claim 14, wherein each of the water-resistant center sheath, the water-resistant left sheath, and the water-resistant right sheaths comprise at least one of a thin plastic sheeting, a coated water-resistant woven fabric, or a coated water-resistant non-woven fabric.

16. The configurable multipurpose mat assembly of claim 14, wherein each of the left lateral width and the right lateral width are at least five times greater than the center thickness.

17. The configurable multipurpose mat assembly of claim 14, wherein the left barrier sleeve portion further includes a left sleeve fastening assembly coupled to secure the left barrier sleeve portion into the left tubular sleeve, and the right barrier sleeve portion further includes a right sleeve fastening assembly coupled to secure the right barrier sleeve portion into the right tubular sleeve.

18. The configurable multipurpose mat assembly of claim 17, wherein the left barrier sleeve portion and the right barrier sleeve portion each include a second configuration wherein the left fastening assembly and the right sleeve fastening assembly is uncoupled and the respective left barrier sleeve portion and right barrier sleeve portion is flat and generally coplanar with the center pocket portion.

19. The configurable multipurpose mat assembly of claim 14, wherein the fabric cover substantially comprises a cotton or cotton-blend woven fabric.

20. A configurable multipurpose mat assembly comprising: an open cell foam center pad having a center thickness, the center pad being encased within a water-resistant center sheath, the water-resistant center sheath including one or more openings to facilitate the ingress and egress of air from in and out of the water-resistant center sheath; an open cell foam elongated left barrier pad having a barrier left longitudinal length and a left lateral width, the elongated left barrier pad being encased within a water-resistant left sheath, the water-resistant left sheath including one or more openings to facilitate the ingress and egress of air from in and out of the water-resistant left sheath; an open cell foam elongated right barrier pad having a barrier right longitudinal length and a right lateral width, each of the left lateral width and the right lateral width being at least five times greater than the center thickness, the elongated right barrier pad being encased within a water-resistant right sheath, the water-resistant right sheath including one or more openings to facilitate the ingress and egress of air from in and out of the right sheath; and a fabric cover having a center pocket portion bordered on a left pocket edge by a left barrier sleeve portion, and bordered on a right pocket edge by a right barrier sleeve portion, the center pocket portion having a receiving pocket end including a pocket closure assembly, the center pocket portion having the center pad removably enclosed therein at the receiving pocket end, the center pocket portion of the fabric cover is integrally formed with both the left barrier sleeve portion and the right barrier sleeve portion, and the left barrier sleeve portion and the right barrier sleeve portion including a respective left fastening assembly and a right fastening assembly, each of the left barrier sleeve portion and the right barrier sleeve portions having at least a first and second configuration, the left barrier sleeve portion and the right barrier sleeve portion in the first configuration being formed into a tubular sleeve wrapped around the respective elongated left barrier pad or elongated right barrier pad and secured in place with the respective left fastening assembly or right fastening assembly and the left barrier sleeve portion and the right barrier sleeve portions in the second configuration being laid flat and generally coplanar with the center pocket portion, wherein (i) the left fastening assembly comprises at least a first left barrier fastening pair comprising a first left barrier fastening piece and a second left barrier fastening piece configured to removably couple with the first left barrier fastening piece, the first left barrier fastening piece being located proximate the left pocket edge and the second left barrier fastening piece being located proximate a left edge of the left barrier sleeve portion and (ii) the right fastening assembly comprises at least a first right barrier fastening pair comprising a first right barrier fastening piece and a second right barrier fastening piece configured to removably couple with the first right barrier fastening piece, the first right barrier fastening piece being located proximate the right pocket edge and the second right barrier fastening piece being located proximate a right edge of the right barrier sleeve portion.

* * * * *